US011549376B2

(12) United States Patent
Jonnalagadda et al.

(10) Patent No.: US 11,549,376 B2
(45) Date of Patent: Jan. 10, 2023

(54) OGV ELECTROFORMED HEAT EXCHANGERS

(71) Applicant: General Electric Company, Schenectady, NY (US)

(72) Inventors: Dattu Guru Venkata Jonnalagadda, Karnataka (IN); Sandeep Kumar, Karnataka (IN); Emily Marie Phelps, Bellbrook, OH (US); Merin Sebastian, Karnataka (IN); Gordon Tajiri, Waynesville, OH (US); Ramana Reddy Kollam, Karnataka (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/363,258

(22) Filed: Jun. 30, 2021

(65) Prior Publication Data

US 2021/0324745 A1 Oct. 21, 2021

Related U.S. Application Data

(62) Division of application No. 15/814,687, filed on Nov. 16, 2017, now Pat. No. 11,078,795.

(51) Int. Cl.
*F01D 25/08* (2006.01)
*F01D 5/18* (2006.01)
(Continued)

(52) U.S. Cl.
CPC ..... *F01D 5/18* (2013.01); *C25D 1/02* (2013.01); *F01D 9/041* (2013.01); *F01D 9/065* (2013.01);
(Continued)

(58) Field of Classification Search
CPC . F01D 5/18; F01D 9/041; F01D 9/065; F01D 25/08; F01D 25/12; C25D 1/02;
(Continued)

(56) References Cited

U.S. PATENT DOCUMENTS 2,642,654 A 6/1953 Ahrens
3,344,855 A 10/1967 Clark
(Continued)

FOREIGN PATENT DOCUMENTS

CN 1449470 A 10/2003
CN 106702439 A 5/2017
(Continued)

OTHER PUBLICATIONS

Extended European Search report corresponding to European Application No. 18206264.6 dated Feb. 25, 2019.
(Continued)

*Primary Examiner* — David E Sosnowski
*Assistant Examiner* — Theodore C Ribadeneyra
(74) *Attorney, Agent, or Firm* — Dinsmore & Shohl LLP

(57) ABSTRACT

A gas turbine engine guide vane heat exchanger has guide vane heat exchanger including electroformed fluid channels in electroformed heat exchanger tubes or a heat exchanger core disposed within airfoil. Non-flammable heat conducting liquid or non-metallic foam may fill space between tubes or core and airfoil. Fluid circuit may include channels within electroformed heat exchanger tubes or the heat exchanger core and extend from inlet manifold to outlet manifold for directing fluid or oil through channels and include fluid or oil supply inlet connected to inlet manifold for receiving the fluid or oil flowed into inlet manifold and a fluid or oil supply outlet connected to fluid or oil supply outlet for discharging fluid or oil flowed out of fluid or oil outlet manifold. Heat exchanger tubes or heat exchanger core, inlet
(Continued)

manifold, outlet manifold, supply inlet and supply outlet may be integrally and monolithically electroformed together.

6 Claims, 10 Drawing Sheets

(51) Int. Cl.
*C25D 1/02* (2006.01)
*F01D 9/04* (2006.01)
*F01D 9/06* (2006.01)
*F01D 25/12* (2006.01)

(52) U.S. Cl.
CPC ..... *F01D 25/08* (2013.01); *F01D 25/12* (2013.01); *F05D 2220/36* (2013.01); *F05D 2230/30* (2013.01); *F05D 2240/12* (2013.01); *F05D 2260/204* (2013.01); *F05D 2260/205* (2013.01); *F05D 2260/98* (2013.01); *F28F 2255/00* (2013.01)

(58) Field of Classification Search
CPC ..... F05D 2220/36; F05D 2230/30; F05D 2240/12; F05D 2260/204; F05D 2260/205; F05D 2260/98; F28F 2255/00
See application file for complete search history.

(56) References Cited

U.S. PATENT DOCUMENTS

| | | | |
|---|---|---|---|
| 3,364,548 | A | 1/1968 | Marco |
| 4,057,475 | A | 11/1977 | Schrader |
| 4,172,771 | A | 10/1979 | Grunke |
| 4,727,935 | A | 3/1988 | Lapeyre |
| 4,914,904 | A | 4/1990 | Pamnes et al. |
| 5,199,487 | A | 4/1993 | DiFrancesco et al. |
| 3,061,032 | A1 | 11/2011 | Banham et al. |
| 8,333,552 | B2 | 12/2012 | Wood et al. |
| 8,616,834 | B2 | 12/2013 | Knight, III et al. |
| 9,422,063 | B2 | 8/2016 | Diaz |
| 2006/0042223 | A1 | 3/2006 | Walker et al. |
| 2007/0134908 | A1 | 6/2007 | Banham et al. |
| 2014/0196286 | A1 | 7/2014 | Hong et al. |
| 2016/0305279 | A1 | 10/2016 | Gerstler et al. |
| 2016/0305718 | A1 | 10/2016 | Donovan et al. |
| 2017/0002685 | A1 | 1/2017 | Todorovic |
| 2017/0159489 | A1 | 6/2017 | Sennoun |
| 2017/0204879 | A1 | 7/2017 | Zaccardi et al. |

FOREIGN PATENT DOCUMENTS

| | | | |
|---|---|---|---|
| EP | 1087037 | A2 | 3/2001 |
| EP | 1630358 | A2 | 3/2006 |
| EP | 2383437 | A2 | 11/2011 |
| EP | 3401420 | A1 | 11/2018 |
| JP | 2002172625 | A | 6/2002 |
| WO | 2015088861 | A1 | 6/2015 |

OTHER PUBLICATIONS

Chinese office action for application 201811360487.9 dated May 12, 2022 (34 pages with English Translation).

OGV ELECTROFORMED HEAT EXCHANGERS

CROSS REFERENCE TO RELATED APPLICATIONS

This application is a divisional application of and claims priority to and the benefit of U.S. Nonprovisional application Ser. No. 15/814,687, filed Nov. 16, 2017, the contents of which is hereby incorporated by reference in its entirety.

BACKGROUND OF THE INVENTION

Technical Field

The present invention relates generally to gas turbine engine turbine oil cooling and, more specifically, to outlet guide vanes containing heat exchangers used to cool oil or other fluids.

Background Information

Gas turbine engines are commonly provided with a circulating oil system for lubricating and cooling various engine components such as bearings, gearboxes, electrical generators, and the like. In operation, the oil absorbs a substantial amount of heat that must be rejected to the external environment in order to maintain the oil at acceptable temperatures. Electric generator oil cooling typically uses one or more air-to-oil heat exchangers sometimes in series with fuel-to-oil heat exchangers and fuel return-to-tank systems in a complex cooling network.

Compact heat exchangers also known as brick coolers or surface coolers have been used for this cooling but both have a fan air drag penalty. Oil cooling circuits have been suggested that include air-to-oil heat exchangers in vanes in the engine and, in particular, in fan outlet guide vanes (OGVs). The use of OGVs as heat exchangers is a zero fan air pressure loss across the OGVs because oil is routed within the OGVs. Because the OGVs are not finned (less exchange area is available versus a brick cooler or a surface cooler), many OGVs will be needed to cool engine oil or electric generator oil. Routing oil in tiny channels inside an OGV is not free and can be done via oil pressure drop inside OGV channels. Using many OGVs will require more oil pressure drop than what is currently available or budgeted in an oil lubrication system or an integrated drive generator (IDG) or variable frequency generator (VFG) oil system. Thus, oil cooling systems and circuits using many OGVs as heat exchangers and able to meet air-oil coolers oil pressure drop requirements is greatly needed. They are expensive and difficult to manufacture so an inexpensive, relatively uncomplicated and easier manufacturing method is also greatly needed. A method of manufacturing a fan outlet guide vane (OGV) with integrated heat exchanger is particularly needed.

SUMMARY OF THE INVENTION

A gas turbine engine guide vane heat exchanger includes electroformed fluid channels in electroformed heat exchanger tubes or a heat exchanger core disposed within an airfoil.

A non-flammable heat conducting liquid may fill a space between the electroformed heat exchanger tubes or heat exchanger core and the airfoil. The space may be solid and filled with metal. The electroformed heat exchanger tubes may have a deposited wall thickness (WT) in a range of about 0.030 inches to 0.1 inches.

The gas turbine engine guide vane heat exchanger may have a fluid circuit including the channels within the electroformed heat exchanger tubes or the heat exchanger core, extending from an inlet manifold to an outlet manifold for directing fluid or oil through the channels, an including a fluid or oil supply inlet connected to the inlet manifold for receiving the fluid or oil flowed into the inlet manifold and a fluid or oil supply outlet connected to the fluid or oil supply outlet for discharging the fluid or oil flowed out of the fluid or oil outlet manifold. The heat exchanger tubes or heat exchanger core, the inlet manifold, the outlet manifold, the supply inlet, and the supply outlet may all be integrally and monolithically electroformed together.

A gas turbine engine having a circular row of fan outlet guide vanes extending across a fan flow path between an annular fan casing and an inner hub located radially inwardly of the fan casing may have in each of one or more of the fan outlet guide vanes a guide vane heat exchanger including electroformed fluid channels in an electroformed heat exchanger tubes or a heat exchanger core, disposed within an airfoil, and outer and inner end flanges supporting the guide vane heat exchanger.

A method for making a gas turbine engine guide vane may include electroforming fluid or oil channels in heat exchanger tubes or a heat exchanger core for a gas turbine engine guide vane heat exchanger. The electroforming includes making a first mold of the fluid or oil channels, electrodepositing a metal or alloy on the first molds, and chemically removing or melting out the first mold and leaving behind the heat exchanger tubes or heat exchanger core and channels therein. The method may further include placing the heat exchanger tubes or the heat exchanger core in a casting mold, pouring aluminum or an alloy into the casting mold, solidifying the aluminum or alloy in the casting mold, and profile grinding the solidified aluminum or alloy into a guide vane including outer and inner end flanges. At least part of the casting mold includes a shape of an airfoil of the vane.

The method may include filling a space between the electroformed heat exchanger tubes or the heat exchanger core and an airfoil of the guide vane with a non-flammable heat conducting liquid or with the aluminum or an alloy when pouring the aluminum or an alloy into the casting mold.

The method may further include making outer and inner end flanges, making a heat exchanger assembly by attaching the end flanges to the electroformed heat exchanger tubes or heat exchanger core, forming an investment casting airfoil mold around the electroformed heat exchanger tubes or the heat exchanger assembly, pouring and solidifying molten aluminum around the airfoil mold into an airfoil casting, and machining the airfoil casting to form the final or near final airfoil. The pouring may include pouring the molten aluminum between the airfoil mold and a gap mold to form an empty space or gap between the electroformed heat exchanger tubes or the heat exchanger core and the airfoil and filling the space with a non-flammable heat conducting liquid.

The method may include making outer and inner end flanges, making a heat exchanger assembly by attaching the end flanges to the electroformed heat exchanger tubes or heat exchanger core, forming an empty space between the electroformed heat exchanger tubes or the heat exchanger core and an airfoil of the vane using a wax or plastic airfoil mold defining the shape of the airfoil including the leading and trailing edges and the convex suction and concave pressure sides, and making the airfoil by electrodepositing Nickel or Nickel alloy on the wax or plastic airfoil mold. The electrodeposited airfoil may be machined to form the final or near final airfoil.

BRIEF DESCRIPTION OF THE DRAWINGS

The invention, in accordance with preferred and exemplary embodiments, is more particularly described in the following detailed description taken in conjunction with the accompanying drawings in which.

DESCRIPTION

Figure 1:
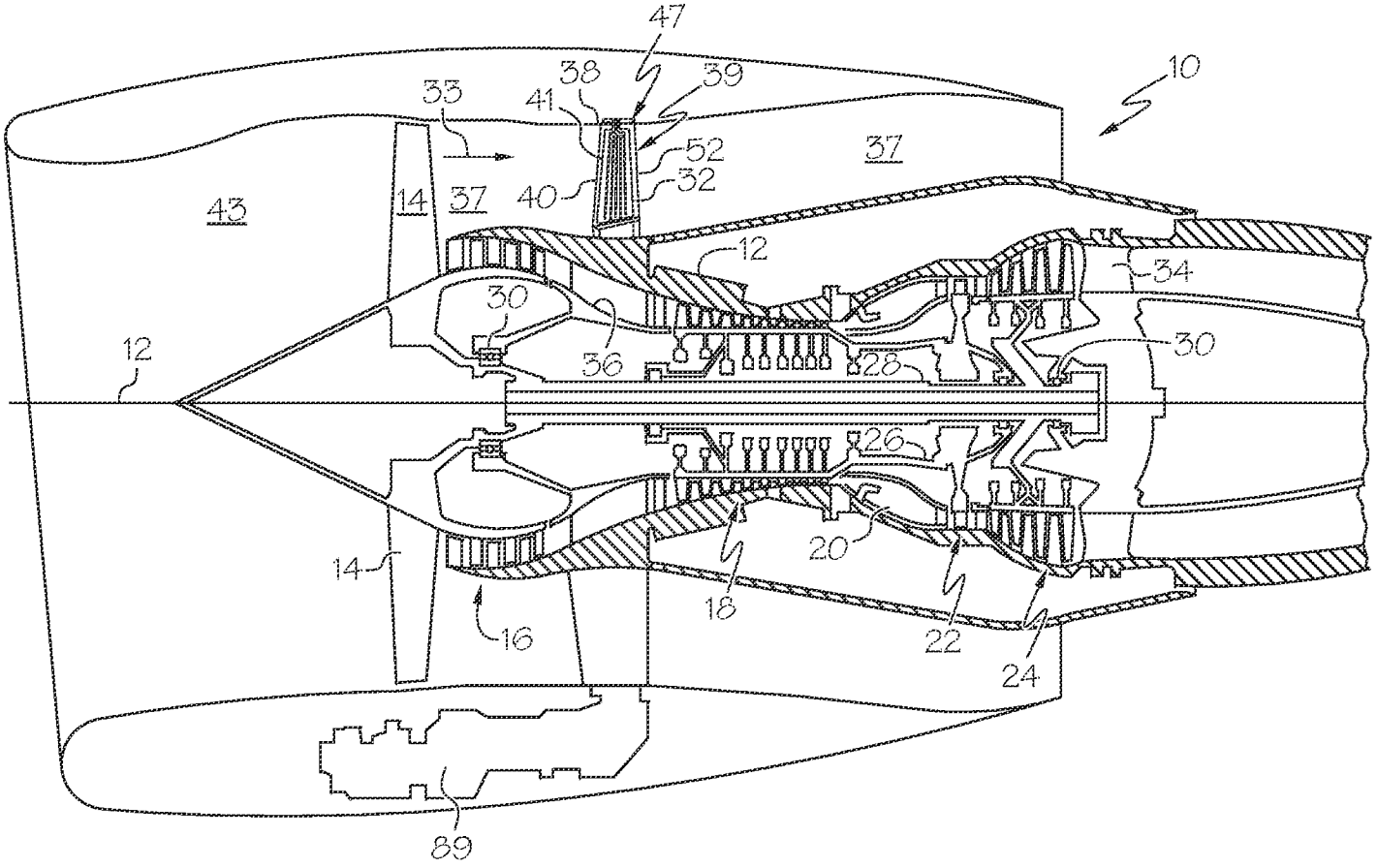
FIG. 1 is a schematic cross-sectional view illustration of a gas turbine engine incorporating an electroformed fan exit guide vane with an internal heat exchanger.
Figure 2:
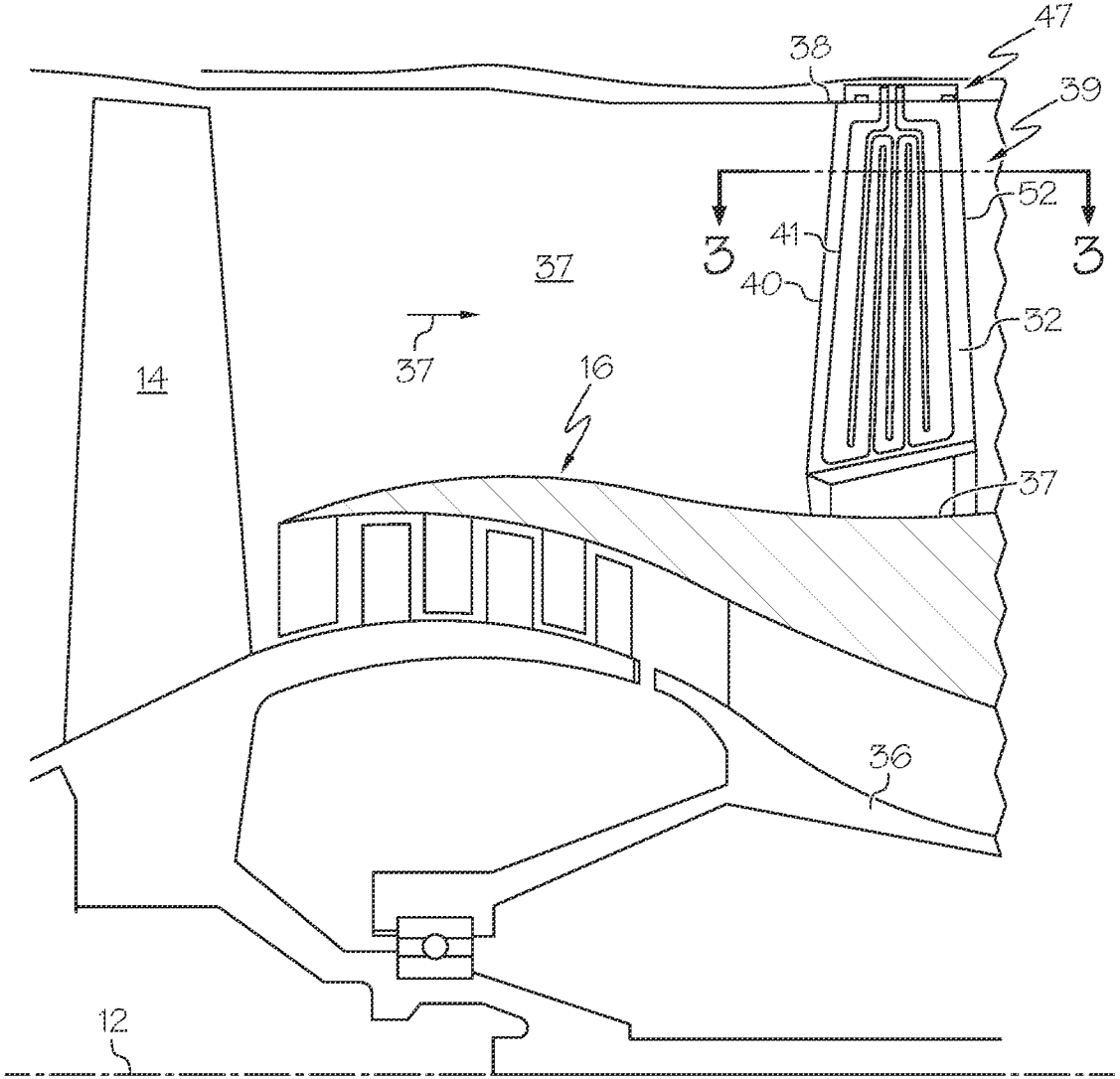
FIG. 2 is an enlarged view of a fan section of the gas turbine engine illustrated in FIG. 1.

Illustrated in FIGS. 1 and 2 is a gas turbine engine 10 incorporating at least one electroformed fan outlet guide vane (OGV) heat exchanger 52. Electroforming enables easy and low cost manufacturing of OGV heat exchangers and other complex parts, which may be easily formed without weld or braze joints. This method enables net shape electroforming of the components in a most cost and weight effective way. This disclosure describes multiple ways of manufacturing optimized OGV heat exchangers.

The engine 10 is circumscribed about a longitudinal centerline or axis 12. The engine 10 includes, in downstream serial flow relationship, a fan 14, booster 16, compressor 18, combustor 20, high pressure turbine 22, and low pressure turbine 24. An outer shaft 26 drivingly connects the high pressure turbine to the compressor 18. An inner shaft 28 drivingly connects the low pressure turbine 24 to the fan 14 and the booster 16. The inner and outer shafts 28, 26 are rotatably mounted in bearings 30 which are themselves mounted in a fan frame 32 and a turbine rear frame 34.

The fan frame 32 includes a radially inner hub 36 connected to a radially outer annular fan casing 38 by an annular array or circular row 39 of radially extending fan outlet guide vanes ("OGVs") 40 (further illustrated in FIG. 3) which extend across a fan flow path 43. The fan OGVs 40 are downstream and aft of the fan 14 and aft of the booster 16. The exemplary embodiment of the engine 10 illustrated herein includes the OGVs 40 providing aerodynamic turning of fan airflow 33 passing through a fan bypass duct 37 and structural support for the fan casing 38. Alternative embodiments may provide separate vanes and struts for aerodynamic and structural functions.

Figure 3:
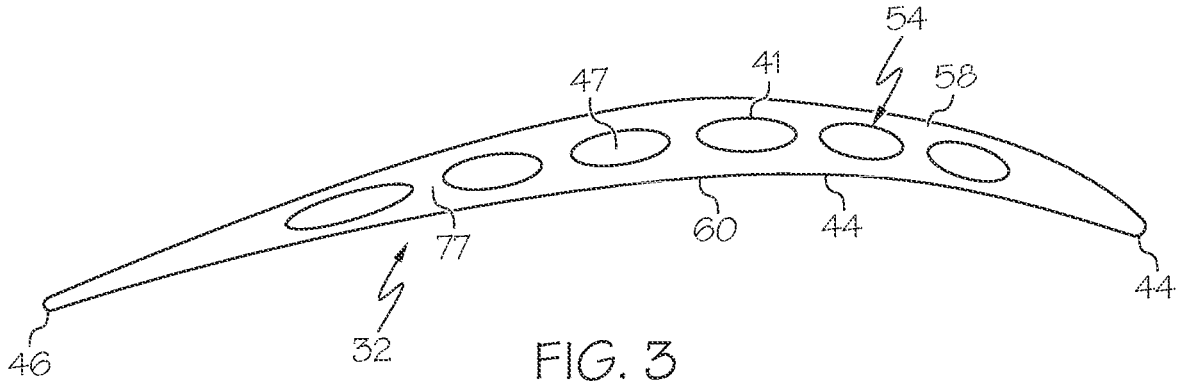
FIG. 3 is a schematical cross-sectional view illustration of the electroformed fan exit guide vane and heat exchanger through 3-3 in FIG. 2.
Figure 4:
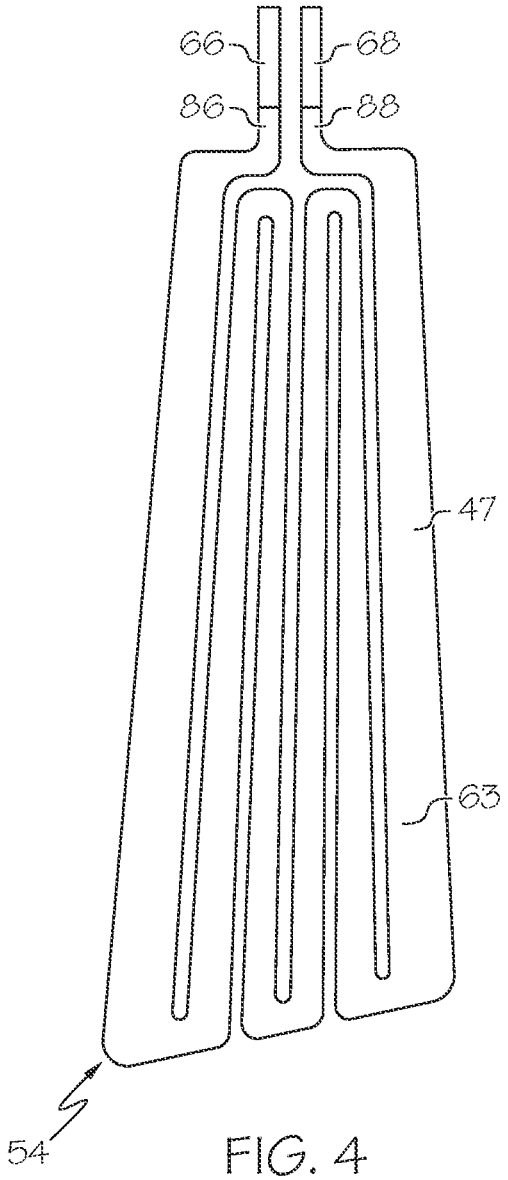
FIG. 4 is a schematical view illustration of electroformed tubes of the heat exchanger illustrated in FIG. 2.
Figure 5:
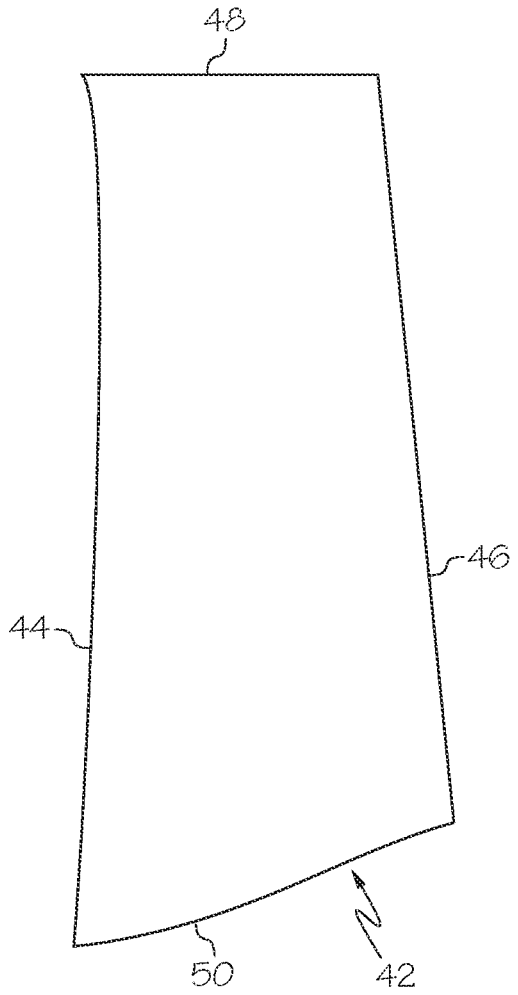
FIG. 5 is a schematical view illustration of an electroformed airfoil of the fan exit guide vane illustrated in FIG. 2.

Referring to FIGS. 3-5, one or more or all of the fan OGVs 40 in the engine 10 include an electroformed fan exit guide vane heat exchanger 52. The electroformed fan exit guide vane heat exchanger 52 include electroformed heat exchanger tubes 41 surrounding fluid or oil channels 47 therein. The electroformed heat exchanger tubes 41 may be disposed within a metallic electroformed or cast airfoil 42 of the fan OGV 40 and, thus, integrated into the structure of the OGV 40. The heat exchanger tubes 41 may be arranged in a heat exchanger core 54. A space 77 between the electroformed heat exchanger tubes 41 or the heat exchanger core 54 and the airfoil 42 may be solid and filled with the same metal as the airfoil 42.

Figure 3A:
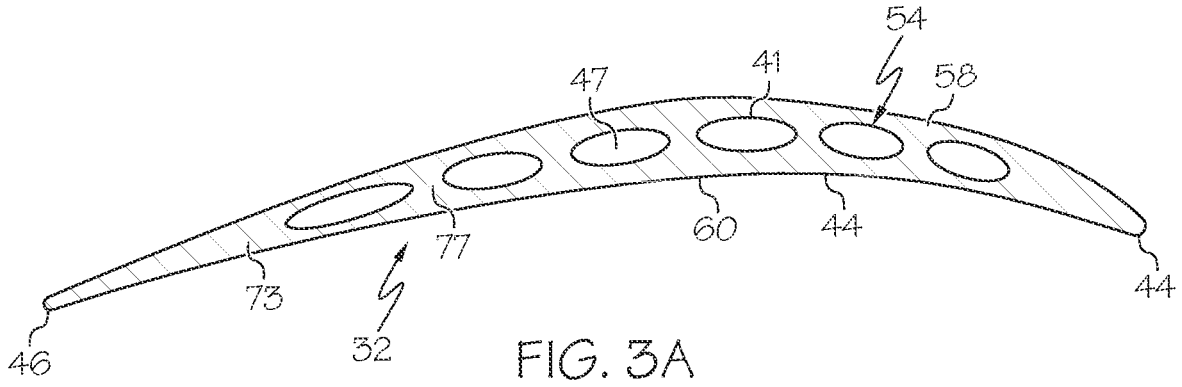
FIG. 3A is a schematical cross-sectional view illustration of an alternative embodiment of the electroformed fan exit guide vane and heat exchanger through 3-3 in FIG. 2.

Alternatively, the space 77 between the electroformed heat exchanger tubes 41 and the airfoil 42 may be filled with a non-flammable heat conducting liquid 73 as illustrated in FIG. 3A. Examples of such a conducting liquid 73 includes Globaltherm, Dynalene, Paratherm etc. Alternatives to the heat conducting non-flammable liquid include metal or non-metallic foam. The conducting liquid 73 provides additional protection against foreign object debris FOD and bird strike damage. The conducting liquid 73 provides a lighter weight design because the fluid is lighter than metal. The conducting liquid 73 serves as a damper for the channels 47 in the electroformed heat exchanger 52.

The electroformed fan exit guide vane heat exchangers 52 may be used to cool oil for the engine's lubrication system for the bearings and/or for a variable frequency generator (VFG) or an integrated drive generator 89 (IDG) oil system. The electroformed fan exit guide vane and the electroformed heat exchanger 52 may be used to provide cooling for different engine systems or accessories. One example of this is a first group of the guide vane heat exchangers 52 may be used to provide cooling for the engine's lubrication system such as for the bearings and a second group of the guide vane heat exchangers 52 may be used to provide cooling for a variable frequency generator (VFG) or an integrated drive generator 89 (IDG).

Figure 6:
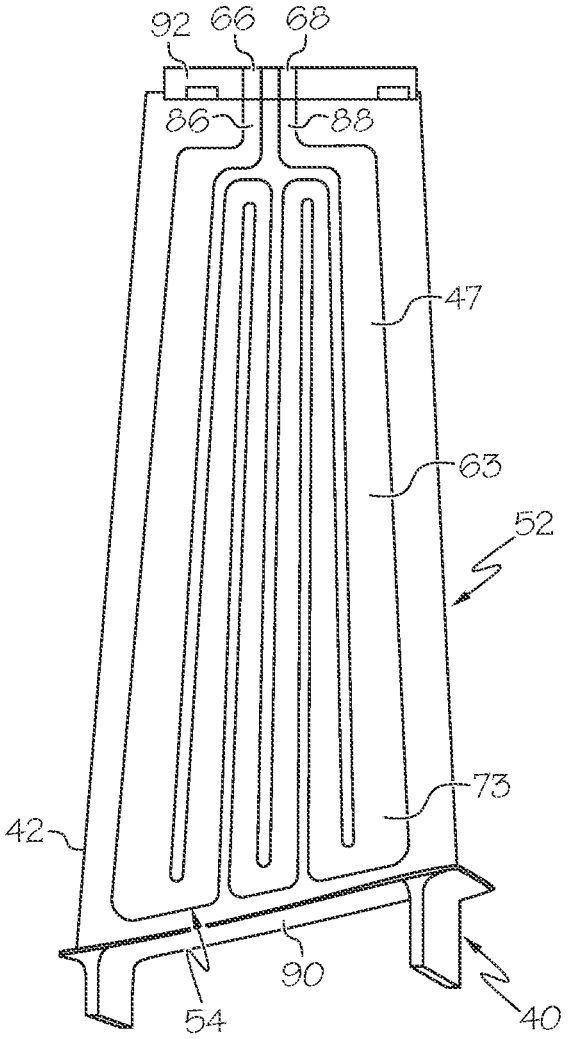
FIG. 6 is a schematical view illustration of the electroformed fan exit guide vane and heat exchanger illustrated in FIG. 2.
Figure 7:
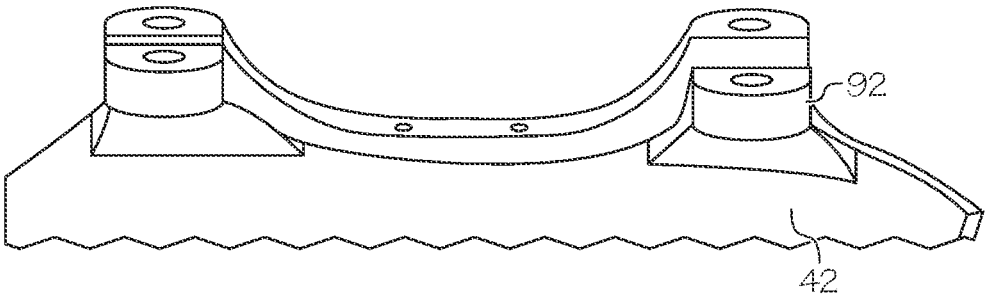
FIG. 7 is a schematical cross-sectional view illustration of an outer end flange of the electroformed fan exit guide vane and heat exchanger illustrated in FIG. 6.
Figure 8:
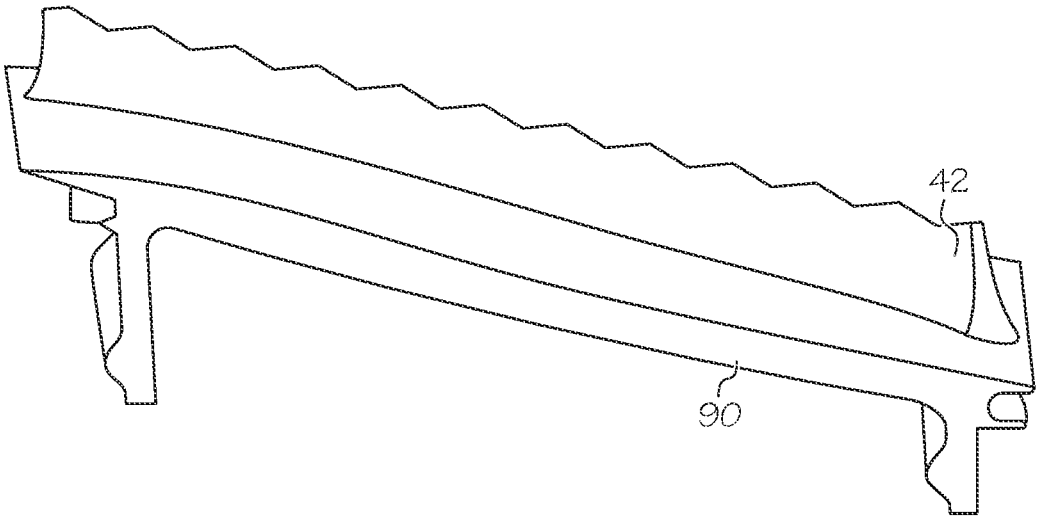
FIG. 8 is a schematical cross-sectional view illustration of an inner end flange of the electroformed fan exit guide vane and heat exchanger illustrated in FIG. 6.
Figure 9:
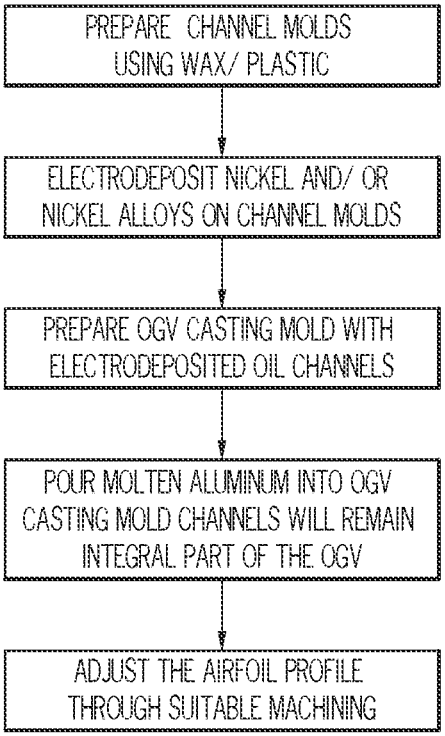
FIG. 9 is a flow chart of a first exemplary method for making an electroformed exit guide vane and heat exchanger such as the one illustrated in FIG. 6.
Figure 10:
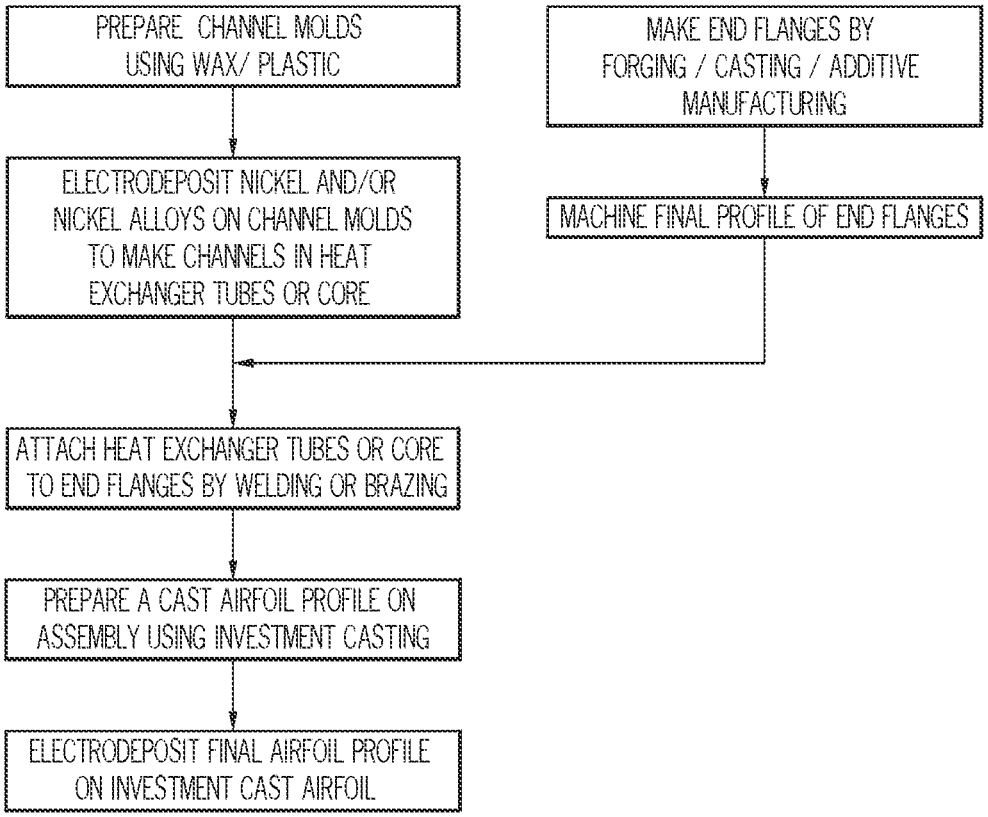
FIG. 10 is a flow chart of a second exemplary method for making an electroformed exit guide vane and heat exchanger such as the one illustrated in FIG. 6.
Figure 11:
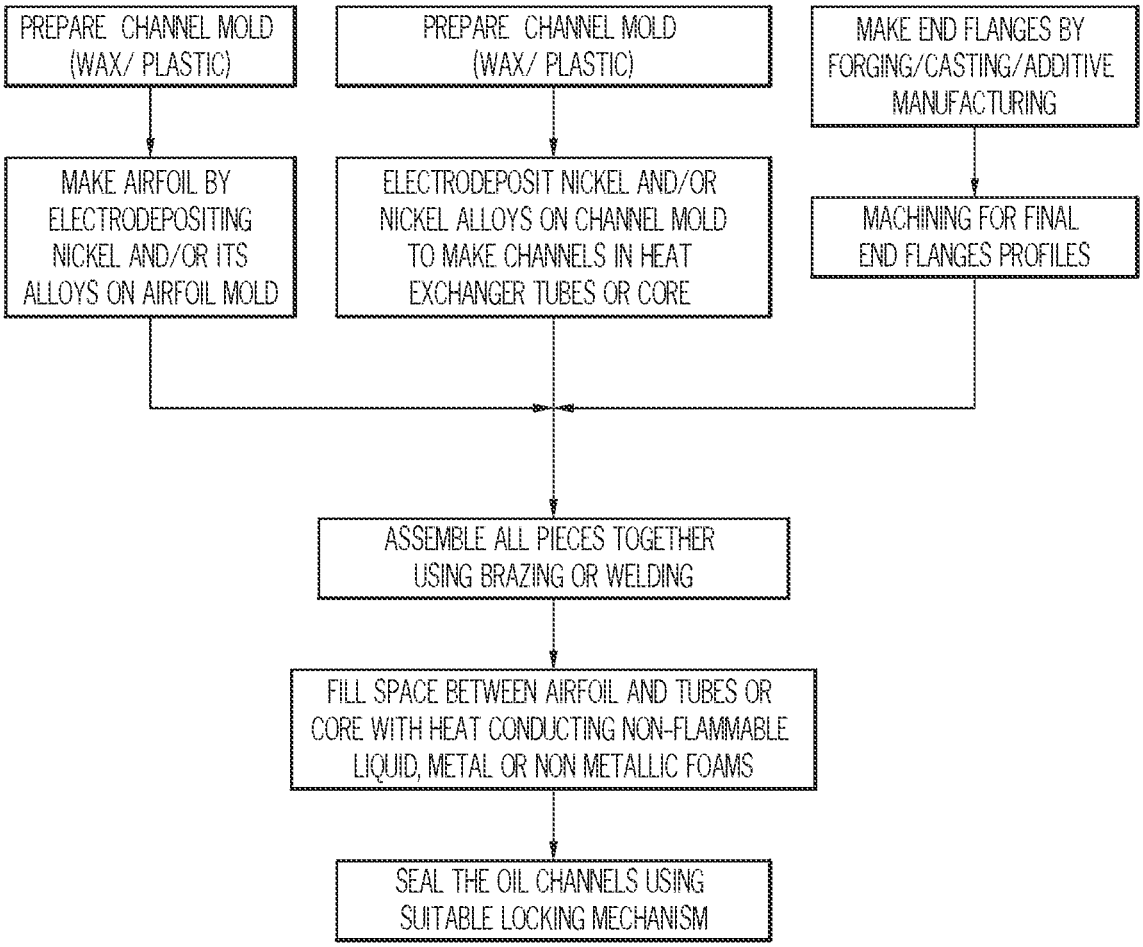
FIG. 11 is a flow chart of a third exemplary method for making an electroformed exit guide vane and heat exchanger such as the one illustrated in FIG. 6.
Figure 12:
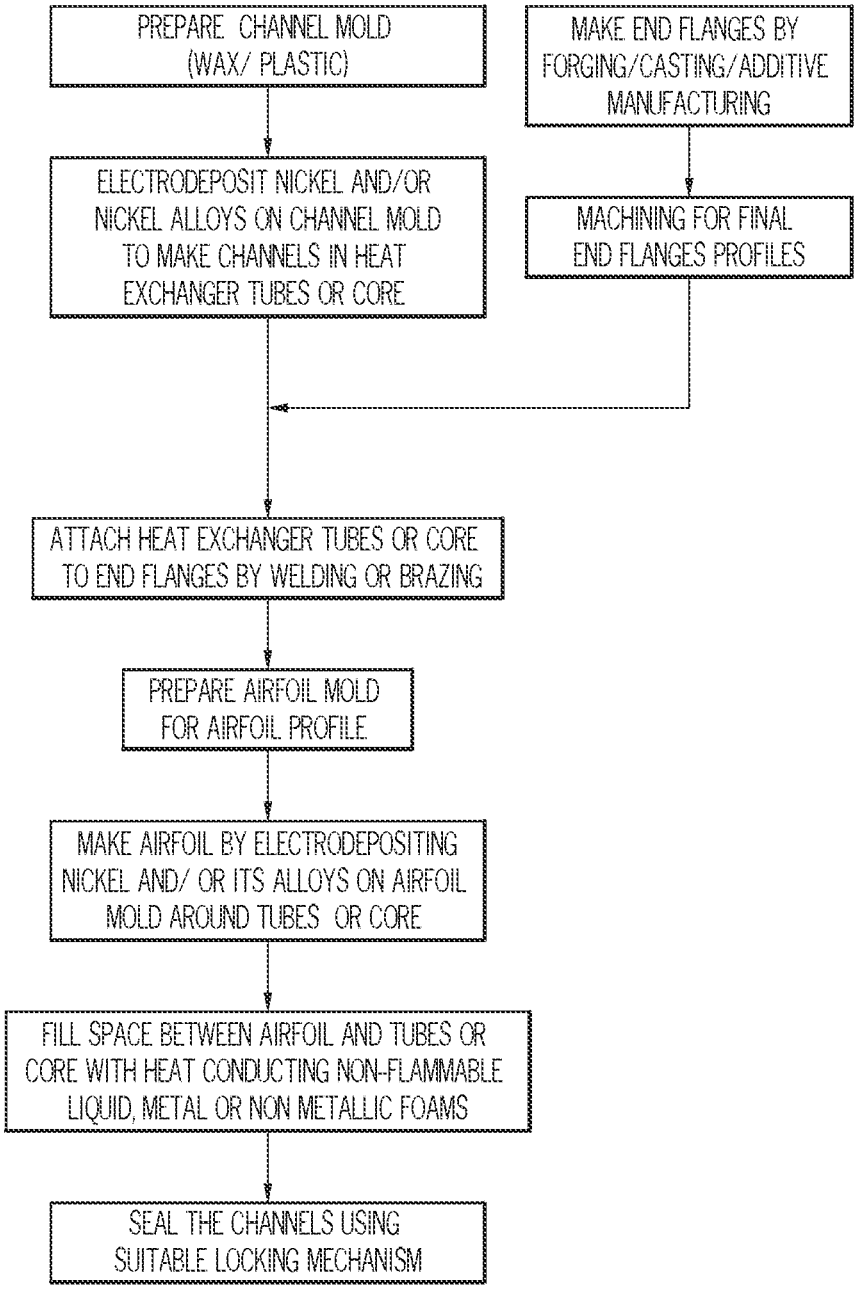
FIG. 12 is a flow chart of a fourth exemplary method for making an electroformed exit guide vane and heat exchanger such as the one illustrated in FIG. 6.

Referring to FIGS. 3, 4, and 6, the airfoil 42 of the fan OGV 40, a leading edge 44, a trailing edge 46, a tip 48, a root 50, a convex suction side 58, and a concave pressure side 60. Each exit guide vane heat exchanger 52 may include an OGV fluid or oil circuit 63 including the OGV heat exchanger tubes 41 and the channels 47 therein in the core 54. The OGV heat exchanger tubes 41 and the channels 47 therein are fluidly connected together in series in the core 54 and in the oil circuit 63, illustrated herein. The oil circuit 63 extends from an oil inlet manifold 66 to an oil outlet manifold 68 and directs fluid or oil through the channels 47 in the OGV heat exchanger tubes 41 or core 54 when the engine 10 is running.

The OGV oil circuit 63 includes an oil supply inlet 86 suitably connected to the oil inlet manifold 66 for receiving oil flowed into the oil inlet manifold 66 and an oil supply outlet 88 suitably connected to the oil supply outlet 88 for discharging oil flowed out of the oil outlet manifold 68. The heat exchanger tubes 41, the oil inlet and outlet manifolds 66, 68, the oil supply inlet and oil supply outlet 86, 88 may all be integrally and monolithically electroformed together.

Referring to FIGS. 3 and 7-9, radially outer and inner end flanges 90, 92 support the heat conducting liquid 73, the electroformed heat exchanger tubes 41, and the airfoil 42 of the electroformed fan exit guide vane heat exchanger 52. The outer and inner end flanges 90, 92 support the electroformed fan exit guide vane heat exchanger 52 in the fan frame 32.

The electroforming process described in this patent is a method where material is built-up onto a form, mandrel, or template surface using a process similar to plating or flame spraying. It allows thinner wall structures to be produced additively, which the more conventional printing processes cannot do. It lends itself well to tubes, ducts, manifolds and other fluid delivery products. The electroforming method of manufacturing enables use of high strength alloys, which enables more optimized configurations. This method enables net shape electroforming of the components in a cost and weight effective way. The mandrel may be used as a temporary form that may be removed chemically or with high temperature. Exemplary mandrel materials include aluminum, plastics and high temperature waxes. An exemplary deposited wall thickness WT of the tubes is about 0.030 inches and may be 0.1 inches or greater.

Four suitable exemplary electroforming methods of manufacturing the OGV heat exchangers disclosed herein are described below. The methods are numbered 1-4 and correspond to flow charts in FIGS. 9-12 respectively.

Method 1: Method 1 may be used for manufacturing the OGV heat exchangers with solid airfoils and metal in the space 77 between the electroformed heat exchanger tubes 41 or the heat exchanger core 54 and the airfoil 42 as illustrated in FIG. 3.

Molds of the channels 47 are made from plastic or wax. Then metal such as Nickel or Nickel alloy is deposited on these molds using electrodeposition to form the electroformed heat exchanger tubes 41 or heat exchanger core 54 containing the channels. An OGV casting mold is prepared and at least part of the OGV casting mold may include a shape of the airfoil 42 of the fan OGV 40.

These heat exchanger tubes 41 or heat exchanger core 54 are then placed in the OGV casting mold and molten aluminum is poured into the mold between the mold and the heat exchanger tubes 41 or heat exchanger core 54, thus, making the channels 47 an integral part of the OGV 40. The molten aluminum is allowed to solidify into an OGV casting and the casting is machined to produce the final or near final airfoil. The OGV including the outer and inner end flanges 90, 92 and the airfoil 42 may be profile ground to a design profile. The OGV casting may include the outer and inner end flanges 90, 92 which may be machined to produce the final or near final flanges. The airfoil 42 and radially outer and inner end flanges 90, 92 may all be integrally and monolithically formed together by the casting and machining processes.

Method 2: Method 2 may be used for manufacturing the OGV heat exchangers with empty space 77 between the electroformed heat exchanger tubes 41 or the heat exchanger core 54 and the airfoil 42 as illustrated in FIG. 3A.

Molds of the channels 47 are made from plastic or high temperature wax. Then metal such as Nickel or Nickel alloy is deposited on these molds using electrodeposition to form the electroformed heat exchanger tubes 41 or heat exchanger core 54 containing the channels. Separately, the outer and inner end flanges 90, 92 are made using forging, casting, or additive manufacturing or other method. A suitable machining operation may be used to make the final shapes of the end flanges.

A heat exchanger assembly is made by attaching the end flanges to the electroformed heat exchanger tubes 41 or heat exchanger core 54 containing the channels 47 using brazing or welding or other suitable method. The empty space 77 between the electroformed heat exchanger tubes 41 or the heat exchanger core 54 and the airfoil 42 is made using a wax mold or by additive printing. An airfoil investment casting mold is formed around the heat exchanger assembly and a gap mold for forming the empty space 77 or gap. Molten aluminum is poured between the airfoil and gap molds to form the airfoil. The molten aluminum is allowed to solidify into an airfoil casting and the airfoil casting is machined to produce the final or near final airfoil. A final airfoil profile may be electrodeposited on the airfoil casting. The gap mold may be a wax mold which is melted out by heating. The gap mold may be made of plastic which is dissolved or burnt out. Then the empty space 77 or gap may be filled with a heat conducting non-flammable liquid.

Method 3: The airfoil 42, the outer and inner end flanges, and the electroformed heat exchanger tubes 41 or the heat exchanger core 54 are separately fabricated and then assembled into the OGV 40 with the electroformed exit guide vane heat exchanger 52.

The airfoil is made by electrodepositing metal such as Nickel or Nickel alloy on an airfoil mold. Molds of the channels 47 are prepared from plastic or wax. Then metal such as Nickel or Nickel alloy is deposited on these molds using electrodeposition to form the electroformed heat exchanger tubes 41 or heat exchanger core 54 containing the channels.

Separately, the outer and inner end flanges 90, 92 are made using forging, casting, or additive manufacturing or other method. A suitable machining operation may be used to make the final shapes of the end flanges. The electroformed heat exchanger tubes 41 or heat exchanger core 54 is placed inside the airfoil. Brazing or welding or other suitable method is used to attach the electroformed heat exchanger tubes 41 or heat exchanger core 54 and the airfoil to the outer and inner end flanges 90, 92. The space 77 or gap between the electroformed heat exchanger tubes 41 or the heat exchanger core 54 and the airfoil 42 may be filled with a heat conducting non-flammable liquid, or metal or non-metallic foam. The channels are sealed using a suitable locking mechanism.

Method 4: Method 4 may be used for manufacturing the OGV heat exchangers with empty space 77 between the electroformed heat exchanger tubes 41 or the heat exchanger core 54 and the airfoil 42 as illustrated in FIG. 3A.

Molds of the channels 47 are made from plastic or high temperature wax. Then metal such as Nickel or Nickel alloy is deposited on these molds using electrodeposition to form the electroformed heat exchanger tubes 41 or heat exchanger core 54 containing the channels. Separately, the outer and inner end flanges 90, 92 are made using forging, casting, or additive manufacturing or other method. A suitable machining operation may be used to make the final shapes of the end flanges.

A heat exchanger assembly is made by attaching the end flanges to the electroformed heat exchanger tubes 41 or heat exchanger core 54 containing the channels 47 using brazing or welding or other suitable method. The empty space 77 between the electroformed heat exchanger tubes 41 or the heat exchanger core 54 and the airfoil 42 is made using a wax or plastic airfoil mold which also defines the shape of the airfoil including the leading and trailing edges 44, 46, and the convex suction and concave pressure sides 58, 60. The airfoil is made of Nickel or Nickel alloy which is deposited on the airfoil mold using electrodeposition. Thus, the airfoil is made using electrodeposition and may be machined to produce the final or near final airfoil. The final airfoil profile may be also electrodeposited on the airfoil mold.

The space 77 or gap between the electroformed heat exchanger tubes 41 or the heat exchanger core 54 and the airfoil 42 may be filled with a heat conducting non-flammable liquid, or metal or non-metallic foam. The channels are sealed using a suitable locking mechanism.

When the outer and inner end flanges 90, 92 are separately manufactured using a forging or casting process the footprint of forging is reduced and, thus, the cost of forging can be greatly reduced. Oil channels are manufactured using electroformed process either by electroless deposition or plating or electroforming method. Airfoil shapes with appropriate reinforcing features may be manufactured using an electroforming method. These individual components are assembled together through conventional manufacturing methods like welding or forging. The gap or space between electroformed tubes and airfoils may be filled using heat conducting non-flammable liquid or a suitable alternative. The heat conducting liquid serves two purposes, it can reduce the weight of the components and during the event of FOD the heat conducting liquid leaks first, thus, preventing leakage of lube oil.

While what been described herein are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A method for making a gas turbine engine guide vane comprising:

electroforming fluid or oil channels in heat exchanger tubes or a heat exchanger core for a gas turbine engine guide vane heat exchanger, the electroforming including making a first mold of the fluid or oil channels, electrodepositing a metal or alloy on the first mold, chemically removing or melting out the first mold and leaving behind the heat exchanger tubes or heat exchanger core and channels therein, placing the heat exchanger tubes or the heat exchanger core in a casting mold, pouring aluminum or an alloy into the casting mold, solidifying the aluminum or alloy in the casting mold, and profile grinding the solidified aluminum or alloy into a guide vane including outer and inner end flanges.

2. The method as claimed in claim 1, further comprising at least part of the casting mold includes a shape of an airfoil of the vane.

3. The method as claimed in claim 1, further comprising filling a space between the electroformed heat exchanger tubes or the heat exchanger core and an airfoil of the guide vane with a non-flammable heat conducting liquid or non-metallic foam.

4. The method as claimed in claim 1, further comprising filling a space between the electroformed heat exchanger tubes or the heat exchanger core and an airfoil of the guide vane with the aluminum or an alloy when pouring the aluminum or an alloy into the casting mold.

5. A method for making a gas turbine engine guide vane comprising:

electroforming fluid or oil channels in heat exchanger tubes or a heat exchanger core for a gas turbine engine guide vane heat exchanger, the electroforming including making a first mold of the fluid or oil channels, electrodepositing a metal or alloy on the first mold, chemically removing or melting out the first mold and leaving behind the heat exchanger tubes or heat exchanger core and channels therein, making outer and inner end flanges, making a heat exchanger assembly by attaching the end flanges to the electroformed heat exchanger tubes or heat exchanger core, forming an investment casting airfoil mold around the electroformed heat exchanger tubes or the heat exchanger assembly, pouring and solidifying molten aluminum around the airfoil mold into an airfoil casting, and machining the airfoil casting to form the final or near final airfoil.

6. The method as claimed in claim 5, further comprising the pouring including pouring the molten aluminum between the airfoil mold and a gap mold to form an empty space or gap between the electroformed heat exchanger tubes or the heat exchanger core and the airfoil and filling the space with a non-flammable heat conducting liquid or non-metallic foam.

* * * * *